US006748192B2

(12) United States Patent
Izawa et al.

(10) Patent No.: US 6,748,192 B2
(45) Date of Patent: Jun. 8, 2004

(54) IMAGE HEATING APPARATUS HAVING METALLIC ROTARY MEMBER CONTACTING WITH HEATER

(75) Inventors: Satoru Izawa, Shizuoka (JP); Akihito Kanamori, Shizuoka (JP); Hiroshi Kataoka, Shizuoka (JP); Eiji Uekawa, Shizuoka (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,218

(22) Filed: Jul. 24, 2002

(65) Prior Publication Data

US 2003/0035667 A1 Feb. 20, 2003

(30) Foreign Application Priority Data

Jul. 26, 2001 (JP) ..... 2001/225439

(51) Int. Cl.[7] ..... G03G 15/20
(52) U.S. Cl. ..... 399/329; 399/333
(58) Field of Search ..... 399/320, 328, 399/329, 330, 333; 219/216; 347/156; 430/99, 124

(56) References Cited

U.S. PATENT DOCUMENTS 4,970,219 A 11/1990 Effland et al. ..... 514/339
5,051,784 A * 9/1991 Yamamoto et al. ..... 399/329
5,149,941 A 9/1992 Hirabayashi et al. ..... 219/216
5,210,579 A 5/1993 Setoriyama et al.
5,450,181 A 9/1995 Tsukida et al.
5,525,775 A 6/1996 Setoriyama et al. ..... 219/216
5,722,026 A 2/1998 Goto et al. ..... 399/333
5,860,051 A 1/1999 Goto et al. ..... 399/529
5,904,871 A 5/1999 Sakai et al. ..... 219/216
5,907,348 A * 5/1999 Ogasawara et al. ..... 399/329 X
5,920,757 A 7/1999 Izawa et al. ..... 399/329
5,960,233 A 9/1999 Goto et al. ..... 399/69
6,002,106 A 12/1999 Kataoka et al. ..... 219/216
6,246,035 B1 * 6/2001 Okuda ..... 219/216 X
6,298,213 B1 10/2001 Miyamoto et al. ..... 399/320
6,438,348 B2 8/2002 Kobaru et al. ..... 399/333

* cited by examiner

*Primary Examiner*—Sandra L. Brase
(74) *Attorney, Agent, or Firm*—Fitzpatrick, Cella, Harper & Scinto

(57) ABSTRACT

The image heating apparatus has a heater and a rotary member rotated while contacting with the heater, and the rotary member has a metal layer contacting with the heater.

In the image heating apparatus, a surface roughness Rz of a contact surface of the metal layer with the heater is 3 $\mu$m or less.

15 Claims, 7 Drawing Sheets

IMAGE HEATING APPARATUS HAVING METALLIC ROTARY MEMBER CONTACTING WITH HEATER

BACKGROUND OF THE INVENTION

1. Field of the Invention

This invention relates to an image heating apparatus suitable if used as a fixing device in an image forming apparatus such as a copying machine or a printer using a recording method such as an electrophotographic method or an electrostatic recording method.

2. Description of Related Art

Heretofore, in a fixing apparatus provided in an image forming apparatus adopting an electrophotographic method, an electrostatic recording method or the like, use has been widely made of a so-called heat fixing apparatus for causing a recording material bearing an unfixed toner image thereon to pass through a nip portion formed between a fixing roller and a pressure roller rotated while being brought into pressure contact with each other to thereby fix the toner image as a permanent image on a recording material.

An example of a conventional heat fixing apparatus is shown in FIG. 9 of the accompanying drawings. The reference numeral 40 designates a fixing roller provided with heating means, and a halogen lamp 41 is disposed in a hollow mandrel 42 of aluminum having a thickness of the order of 1 mm to 4 mm so as to satisfy mechanical strength, and heating sufficient to fuse a toner on a recording material P from the interior of the hollow mandrel 42 is effected by the supply of electric power from a power source, not shown.

A substance generally having an absorption rate of 90% or greater for black (e.g. okitsumo or the like) is generally applied to the interior of the hollow mandrel 42 to make the absorption of radiant heat be the halogen lamp 41 good, and the inner surface of the hollow mandrel is made rough with a view to make the absorption rate high, and the roughness thereof Rz is 10 $\mu$m or greater.

Also, in order that the toner on the recording material P may be fixed on the recording material P without being offset on the fixing roller, a mold releasable layer 43 of polytetrafluoroethylene (PTFE), parfluoroalchorytetrafluoroethylene copolymer (PFA) or the like exhibiting excellent performance in mold releasability is formed on the outer side of the hollow mandrel 42.

The mold releasable layer 43 is formed in a tube shape or formed by electrostatic spray, dipping application or the like on the hollow mandrel 42 having its outer surface subjected to blast process, etching process or the like and having its surface roughness Rz made into 5 $\mu$m or greater, and obtains an adhesive force relative to the hollow mandrel 42.

Also, in some cases, in order to prevent offset caused by the surface of the fixing roller 40 being charged up by the conveyance of the recording material P, an electrically conductive material such as carbon black is mixed with the mold releasable layer 43.

Further, the hollow mandrel 42 of the fixing roller 40 is electrically earth-connected or grounded through a diode element, and has a bias applied thereto by bias applying means, not shown, to thereby prevent the surface of the fixing roller from being charged up and producing an offset image.

Also, a thermistor 44 is in contact with the surface of the fixing roller 40, and detects the temperature of the surface of the fixing roller to thereby on/off-control the supply of electric power to the halogen lamp 41 so as to heat the toner image on the recording material P at a moderate temperature.

On the other hand, the reference numeral 50 denotes a pressure roller brought into pressure contact with the fixing roller 40 in the lengthwisely opposite end portions thereof by pressure springs, not shown, to thereby nip and convey the recording material P. The pressure roller 50 comprises a mandrel 51 having applied to the outside thereof an elastic layer formed by molding silicon rubber or a sponge elastic layer 52 formed by foaming silicon rubber and further having applied to the outer layer thereof in a tube shape or as a coating a mold releasable layer 53 of PTFE, PFA, FEP or the like similar to that of the fixing roller 40.

Consequently, a fixing nip portion N of a sufficient nip width can be formed between the two rollers 40 and 50 by the elasticity of the pressure roller 50. The toner image on the recording material P nipped and conveyed by this fixing nip portion N can be fixed by the heating from the fixing roller 40.

Also, particularly a method whereby electric power is not supplied to a heat fixing apparatus during standby, and electric power consumption is minimized, and more particularly an example of a heat fixing method by a film heating process for fixing a toner image on a recording material through thin film between a heater portion and a pressure roller is proposed in Japanese Patent Application Laid-Open No. 63-313182, Japanese Patent Application Laid-Open No. 2-157878, Japanese Patent Application Laid-Open No. 4-44075, Japanese Patent Application Laid-Open No. 4-204980, etc.

FIG. 10 of the accompanying drawings schematically shows the construction of an example of a fixing apparatus of the film heating type. In FIG. 10, the fixing apparatus has a heating member (a heating body, hereinafter referred to as the heater) 61 fixedly supported by a stay holder (supporting member) 62, and an elastic pressure roller 50 brought into pressure contact with the heater 61 by pressure means with a fixing nip portion N of a predetermined nip width formed with heat-resistant thin film (hereinafter referred to as the fixing film) 63 interposed therebetween.

The heater 61 is heated and attempered to a predetermined temperature by electrical energization.

The fixing film 63 is a cylindrical or endless belt-shaped or rolled web-shaped member moved in the direction of arrow by the rotational force of driving means, not shown, or the pressure roller 50 while being in close contact with and sliding relative to the surface of the heater 61 in the fixing nip portion N.

When with the heater 61 heated and attempered to the predetermined temperature and the fixing film 63 moved in the direction of arrow, a recording material P bearing thereon an unfixed toner image as a material to be heated is introduced between the fixing film 63 and the pressure roller 50 in the fixing nip portion N, the recording material P is nipped and conveyed through the fixing nip portion N with the fixing film 63 while being in close contact with the surface of the fixing film 63. In this fixing nip portion N, the recording material and the toner image thereon are heated by the heater 61 through the fixing film 63, and the toner image on the recording material P is heat-fixed. That portion of the recording material which has passed through the fixing nip portion N is stripped from the surface of the fixing film 63 and is conveyed.

A ceramic heater is generally used as the heater 61 as a heating member. It is formed, for example, by forming an electrically energizing heat generating resistance layer of silver palladium (Ag/Pd), $Ta_2N$ or the like on the surface of a ceramic substrate of electrical insulativeness, good heat conductivity and low heat capacity such as alumina (that surface facing the fixing film 63) along the lengthwise direction of the substrate (a direction perpendicular to the plane of the drawing sheet of FIG. 10) by screen printing or the like, and covering the heat generating resistance layer forming surface with a thin glass protective layer. This ceramic heater 61 is such that the electrically energizing heat generating resistance layer thereof is electrically energized to thereby generate heat and the entire heater including the ceramic substrate and the glass protective layer rapidly rises in temperature. This temperature rise of the heater 61 is detected by temperature detecting means 64 installed on the back of the heater and is fed back to an electrical energization controlling portion, not shown. The electrical energization controlling portion controls the electrical energization of the electrical energizing heat generating resistance layer so that the temperature of the heater detected by the temperature detecting means 64 may be maintained at a predetermined substantially constant temperature (fixing temperature). That is, the heater 61 is heat and attempered to the predetermined fixing temperature.

The fixing film 63 has its thickness made as small as 20 to 70 $\mu$m in order to efficiently give the heat of the heater 61 to the recording material P as the material to be heated in the fixing nip portion N. The fixing film 63 is comprised of three layers, i.e., a film base layer, an electrically conductive primer layer and a mold releasable layer, and the film base layer side is the heater side and the mold releasable layer is the pressure roller side. The film base layer is polyimide, polyamideimide, PEEK or the like which is high in insulativeness, and has heat resistance, and is formed to a flexible thickness of the order of 15 to 60 $\mu$m. Also, the mechanical strength such as tear strength of the entire fixing film 63 is kept by the film base layer. The electrically conductive primer layer is formed by a thin layer having a thickness of the order of 2 to 6 $\mu$m, and is electrically connected to the earth to prevent the charging-up of the entire fixing film. The mold releasable layer is a toner offset preventing layer for the fixing film 63, and is formed by coating fluorine resin such as PFA, PTFE or FEP which is good in mold releasability to a thickness of the order of 5 to 14 $\mu$m. Also, like the fixing roller 40 of FIG. 9, in order to mitigate the charging-up of the surface of the fixing film 63 and prevent electrostatic offset, an electrically conductive material such as carbon black having specific resistance of the order of $10^3$ Ωcm to $10^6$ Ωcm is mixed with the mold releasable layer.

Also, the stay holder 62 is formed, for example, by a heat-resitant plastic member, and holds the heater 61 and serves also as a conveying guide for the fixing film 63. In order to enhance the slid ability relative to the fixing film 63, highly heat-resistant grease or the like is interposed between the fixing film 63 and the outer peripheral surface of the heater 61 or the stay holder 62. Also, the pressure member 50 is similar in construction to the pressure roller of the above-described heat fixing apparatus of the fixing roller type.

Also, in order to form the fixing nip portion N necessary for heat fixing between the fixing film 63 and the pressure roller 50, the opposite end portions of the stay holder 62 are pressurized against the pressure roller 50 side by pressure springs, not shown. Thereby, the heater 61 attached to the stay holder 62 is brought into close contact with the fixing film 63 over a portion of the circumferential direction and the entire lengthwise area of the pressure roller 50.

Also, the pressure roller 50 is rotatively driven and therewith, the fixing film 63 is driven to rotate by the surface of the pressure roller 50. In this state, the electrically energizing heat generating resistance layer formed on the heater 61 is electrically energized by a connector, not shown, through electrode portions formed on the opposite end portions of the heater 61. Thereby, the electrically energizing heat generating resistance layer is heated and rises in temperature to thereby heat and fix the toner image on the recording material nipped and conveyed by the fixing nip portion.

The above-described heat fixing apparatus, however, suffers from problems as mentioned below.

First, in the case of the heat fixing apparatus using the fixing roller 40, the thickness of the fixing roller mandrel 42 need to be of the order of 1 to 4 mm in order to satisfy the mechanical strength thereof, and has great heat capacity. Therefore, it is necessary to prelimarily heat the fixing roller 40 to a predetermined temperature before the image forming apparatus receives a print signal. This is because it is difficult to heat the fixing roller 40 from the room temperature to a temperature capable of fixing in the short time until the recording material P having an unfixed toner image formed thereon is conveyed to the heat fixing apparatus, and it becomes necessary to heat the fixing roller to a certain extent in the standby state before the image forming apparatus receives the print signal.

Therefore, when the power source of the image forming apparatus has been turned on from a state in which the fixing roller 40 has been cooled to the room temperature state, it has been necessary to heat the fixing roller 40 until the image forming apparatus becomes capable of receiving the print signal.

Also, it is necessary to heat the fixing roller 40 to a predetermined temperature by the electrical energization of the heater 41 during standby and therefore, energy was wastefully used.

Also, even when an attempt is made to cope with the problem by making the thickness of the mandrel 42 small, if an attempt is made to heat the fixing roller by the radiant of the heater 41 as in the above-described example of the related art, heat efficiency is not good and therefore, preliminary heating likewise becomes necessary when the recording material conveying speed becomes high by the higher speed of the image forming apparatus.

Also, when an attempt is made to make the temperature rising speed higher by making the thickness of the mandrel 42 smaller, the strength of the mandrel 42 is not sufficient and therefore, when the mandrel is pressurized with a strong pressure force, it is greatly flexed and comes to have cracks or the like therein, and this has led to a problem in durability.

On the other hand, in the heat fixing apparatus of the film heating type, the electrical energization of the heater 61 during standby as described above is not required, and even if the electrical energization of the heater 61 is effected after the image forming apparatus has received the print signal, it is possible to bring about a state in which heating is possible by the time when the recording material P arrives at the heat fixing apparatus. Consequently, from the viewpoint of energy saving, the heat fixing apparatus of the film heating type is an excellent heat fixing apparatus that does not waste energy.

However, the fixing film 63 is formed by a resin layer insufficient in heat conductivity, and has been unsuitable for the higher speed of the image forming apparatus. That is, when the image forming apparatus is made higher in speed, the heating speed given to the recording material P from the heater 61 through the fixing film 63 must be increased correspondingly to the higher speed of the apparatus, but for the fixing film 63 made of resin, there is a limitation even if there is taken a measure such as mixing a heat-conductive filler with the film, and it will become impossible to cope with still a higher speed.

So, as a fixing device which consumes little electric power and can cope with high-speed printing, it is proposed in Japanese Patent Application Laid-Open No. 5-61371, Japanese Patent Application Laid-Open No. 9-16004, etc. to make a rotary member contacting with the heater of metal.

By making the rotary member of metal, heat conductivity is improved and high-speed printing can be coped with.

However, there arise the new problems of the reduced durability and the rise of driving torque by the friction between the heater and the rotary member.

Also, when the surface of the metal is rough, the contact thermal resistance between the heater and the rotary member becomes great and the effect of making the rotary member of metal to thereby improve heat conduction decreases.

SUMMARY OF THE INVENTION

The present invention has been made in view of the above-noted problems and an object thereof is to provide an image heating apparatus that can cope with high-speed heating.

Another object of the present invention is to provide an image heating apparatus that is excellent in the heat conductivity until heat reaches a toner.

Still another object of the present invention is to provide an image heating apparatus in which the driving torque of a rotary member can be suppressed.

Yet still another object of the present invention is to provide an image heating apparatus that is excellent in durability.

A further object of the present invention is to provide an image heating apparatus comprising:

a heater; and a rotary member rotated while contacting with the heater, the rotary member having a metal layer contacting with the heater;

wherein a surface roughness Rz of a surface of the metal layer which contacts with the heater is 3 $\mu$m or less.

Still a further object of the present invention is to provide a rotary member for use in an image heating apparatus having:

a metal layer lying on the innermost surface of the rotary member;

wherein the surface roughness Rz of the inner peripheral surface of the metal layer is 3 $\mu$m or less.

Further objects of the present invention will become apparent from the following detailed description when read with reference to the accompanying drawings.

DESCRIPTION OF THE PREFERRED EMBODIMENTS (First Embodiment)

(A) Example of an Image Forming Apparatus

Figure 1:
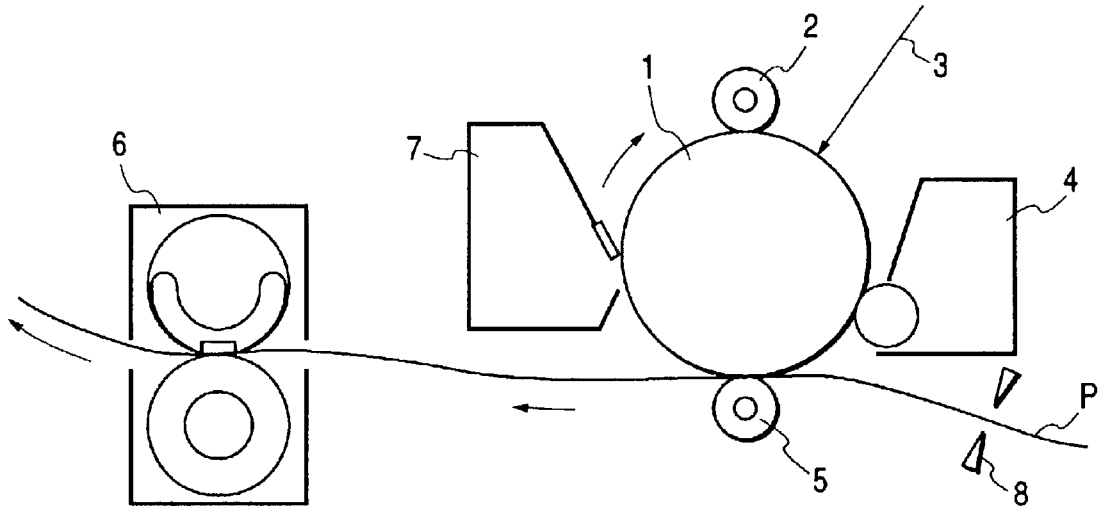
FIG. 1 is a schematic view of a printer carrying the image heating apparatus of the present invention thereon.

FIG. 1 is a model view schematically showing the construction of an example of an image forming apparatus.

The reference numeral 1 designates a photosensitive drum having a photosensitive material such as OPC, amorphous Se or amorphous Si formed on a cylinder-shaped substrate of aluminum, nickel or the like.

The photosensitive drum 1 is rotatively driven in the direction of arrow, and the surface thereof is first uniformly charged by a charging roller 2 as a charging device.

Next, the photosensitive drum is subjected to scanning exposure by a laser beam 3 ON/OFF-controlled in conformity with image information, whereby an electrostatic latent image is formed thereon.

This electrostatic latent image is developed and visualized by a developing apparatus 4. As the developing method, use is made of the jumping developing method, the two-component developing method, the FEED developing method or the like, and image exposure and reversal developing are often used in combination.

The visualized toner image is transferred from the photosensitive drum 1 onto a recording material P conveyed at predetermined timing by a transferring roller 5 as a transferring apparatus.

Here, the leading edge of the recording material P is detected by a sensor 8 so that the formed position of the toner image on the photosensitive drum 1 and the writing start position on the leading edge of the recording material may coincide with each other, and the timing thereof is adjusted. The recording material P conveyed at predetermined timing is nipped and conveyed by the photosensitive drum 1 and the transferring roller 5 with a constant pressure force.

This recording material P to which the toner image has been transferred is conveyed to a heat fixing apparatus 6, where the toner image is fixed as a permanent image.

On the other hand, any untransferred residual toner residual on the photosensitive drum 1 is removed from the surface of the photosensitive drum 1 by a cleaning apparatus 7.

(B) Heat Fixing Apparatus 6

Figure 2:
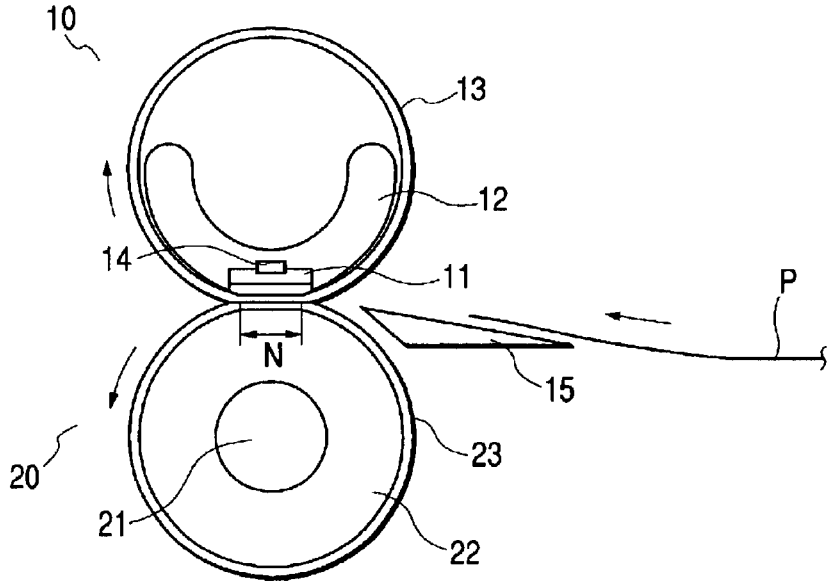
FIG. 2 is a cross-sectional view of the image heating apparatus of the present invention.

FIG. 2 is a model view schematically showing the construction of the heat fixing apparatus 6. The reference numeral 10 denotes a fixing member, and the reference numeral 20 denotes a pressure member, and these two are brought into pressure contact with each other to thereby form a fixing nip portion. The fixing member 10 comprises a heater 11 as a heating member, an adiabatic stay holder 12, a fixing sleeve 13, etc. The pressure member 20 is a heat-resistant elastic pressure roller.

a) Fixing Sleeve 13

The fixing sleeve (rotary member) 13 is a sleeve of small heat capacity, and is a metallic sleeve (film) having as a base layer a metal such as SUS, Al, Ni, Cu or Zn having a thickness of 100 $\mu$m or less and having high heat conductivity or an alloy of these in order to make quick start possible.

Also, a thickness of 20 $\mu$m or greater is necessary for a metallic sleeve having sufficient strength and excellent durability in order to be a heat fixing apparatus of long life. Consequently, 20 $\mu$m or greater and 100 $\mu$m or less is optimum as the thickness of the base layer of the metallic sleeve 13.

Further, in order to prevent offset and secure the separability of the recording material, heat-resistant resin of good mold releasability such as fluorine resin such as PTFE (polytetrafluoroethylene), PFA (tetrafluoroethylene-parfluoroalkylvinyl-ether copolymer), FEP (tetrafluoroethylene-hexafluoropropylene copolymer), ETFE (ethylene-tetrafluoroethylene copolymer), CTFE (polychlorotrifluoroethylene) or PVDF (polyvinylidenefluoride) or silicone resin is mixed with or singly coats the surface layer.

The coating method may be a method of applying a primer layer as an adhesive layer to the outer surface of a metallic sleeve base material, and thereafter applying the mold releasable layer by dipping, powder spray or the like, or a method of covering the surface of the metallic sleeve with what is formed into a tube shape.

The surface roughness of the inner and outer surfaces of the metallic sleeve which is the main portion of the present embodiment, the thickness of the mold releasable layer, etc. will be described in detail in item e) below.

b) Heating Heater 11

The heating heater 11 is provided in the interior of the metallic sleeve 13 which is a fixing sleeve, whereby the heating of the nip portion for fusing and fixing the toner image on the recording material P is effected.

Figure 3A:
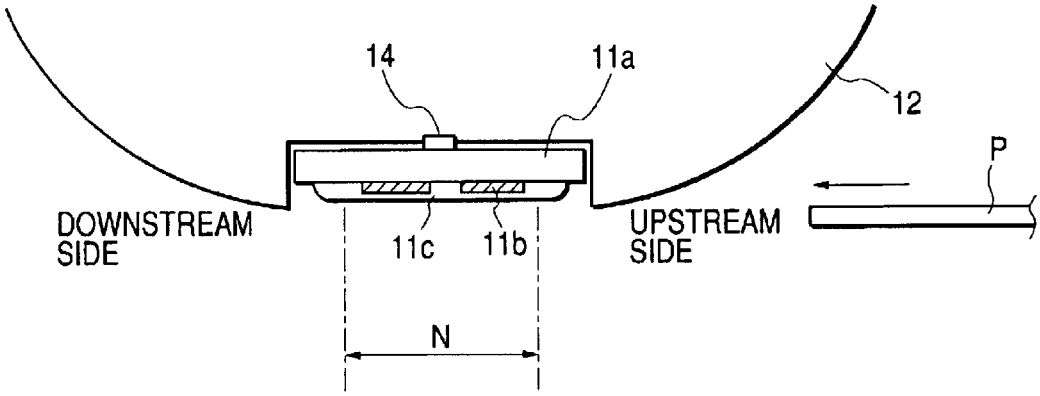
FIG. 3A is a cross-sectional view of an embodiment in which the heat generating layer of a heater is on the nip-opposed surface side of a substrate.
Figure 3B:
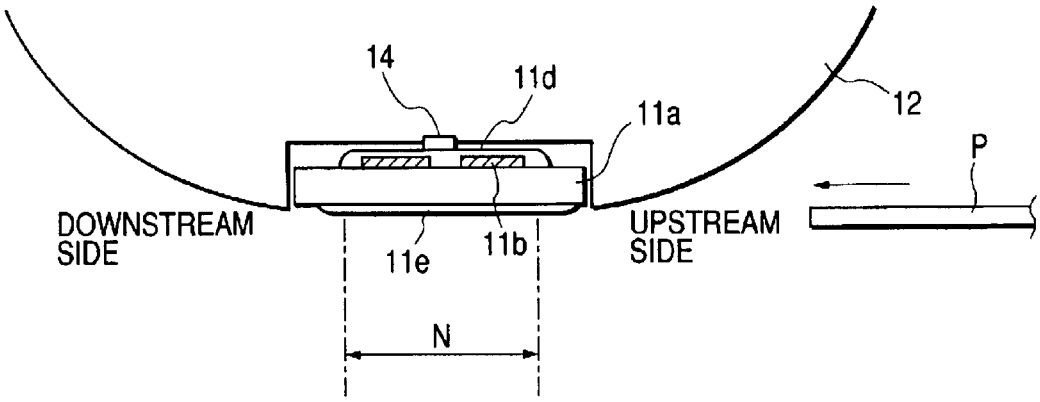
FIG. 3B is a cross-sectional view of an embodiment in which the heat generating layer of the heater is on the surface side opposite to the nip-opposed surface of the substrate.

FIGS. 3A and 3B are model views showing the construction of the vicinity of the heating heater. In FIG. 3A, the heating heater 11 comprises a substrate 11*a* formed of highly insulative ceramics such as alumina or AlN (aluminum nitride) or heat-resistant resin such as polyimide, PPS or liquid crystal polymer, and an electrical energizing heat generating resistance layer 11*b* of e.g. Ag/Pd (silver palladium), $RuO_2$, $Ta_2N$ or the like applied to the surface of the substrate 11*a* along the lengthwise direction thereof in the shape of a line or a thin band having a thickness of the order of 10 $\mu$m and a width of the order of 1 to 5 mm by screen printing or the like. On the surface of the electrical energizing heat generating resistance layer 11*b*, there are provided a thin layer of fluorine resin which can stand the frictional contact with the metallic sleeve 13, and a sliding layer formed of heat-resistant resin such as polyimide, polyamideimide or PEEK.

On the back (the side opposite to the fixing nip portion N) of the substrate 11*a*, there is disposed a temperature detecting element 14 such as a thermistor for detecting the temperature of the heating heater 11 rising in temperature in conformity with the heat generation of the electrical energizing heat generating resistance layer 11*b*. The duty ratio, wave number, etc. of a voltage applied from electrode portions 11*f* and 11*g* at the lengthwise and portions shown in FIG. 4 to the electrical energizing heat generating resistance layer 11*b* are appropriately controlled in conformity with the signal of the temperature detecting element 14, whereby the temperature in the fixing nip portion N is kept substantially constant and heating necessary to fix the toner image on the recording material P is effected. DC supply from the temperature detecting element 14 to a temperature controlling portion, not shown, is achieved by a connector, not shown, through a DC supplying portion and a DC electrode portion, not shown.

When AlN (aluminum nitride) or the like which is good in heat conductivity is used as the heater substrate 11*a*, the electrical energizing heat generating resistance layer 11*b* may be formed on the surface of the substrate 11*a* which is opposite to the fixing nip portion N side, as shown in FIG. 3B. In FIG. 3B, the reference character 11*d* designates a protective layer such as a glass coat or a fluorine resin layer provided to satisfy the withstand voltage between the electrical energizing heat generating resistance layer 11*b* formed on the substrate 11*a* and the temperature detecting element 14. Also, the reference character 11*e* denotes a sliding layer formed of a thin layer of fluorine resin capable of standing the frictional contact with the metallic sleeve or heat-resistant resin such as polyimide, polyamideimide or PEEK, like the above-described 11*c*.

Also, if the shape of that side of the heating heater 11 which is adjacent to the fixing nip portion N is made into a curved surface so that no bending load may be given to the metallic sleeve 13, there will be formed a fixing member of long life. Instead of the ceramic substrate, a metallic substrate may be used as the substrate of the heater, to thereby provide a metallic heating heater comprising an insulating layer and an electrical energizing heat generating resistance layer successively laminated on that side of this metallic substrate that is opposite to the fixing nip portion. This metallic substrate may be of a shape in which the fixing nip portion side thereof is curved in the same direction as the metallic sleeve.

c) Adiabatic Stay Holder 12

The adiabatic stay holder 12 is an adiabatic member for holding the heating heater 11, and preventing the radiation in a direction opposite to the fixing nip portion N, and is formed of a liquid crystal polymer, phenol resin, PPS, PEEK or the like. The metallic sleeve 13 is fitted to this holder with a margin, and is disposed for rotation in the direction of arrow. Also, the metallic sleeve 13 is rotated while being in frictional contact with the heating heater 11 and the adiabatic stay holder 12 and therefore, the frictional resistance between the heating heater 11 and the metallic sleeve 13 and between the adiabatic stay holder 12 and the metallic sleeve 13 need be made small. Therefore, a small amount of lubricant such as heat-resistant grease is interposed on the surfaces of the heating heater 11 and the adiabatic stay holder 12. Thereby, the metallic sleeve 13 becomes smoothly rotatable.

d) Pressure Roller 20

The pressure roller 20 comprises a mandrel 21 and an elastic layer 22 formed on the outer side thereof by foaming heat-resistant rubber such as silicon rubber or fluorine rubber or silicon rubber, and a mold releasable layer 23 of PFA, PTFE, FEP or the like may be formed thereon.

Figure 4:
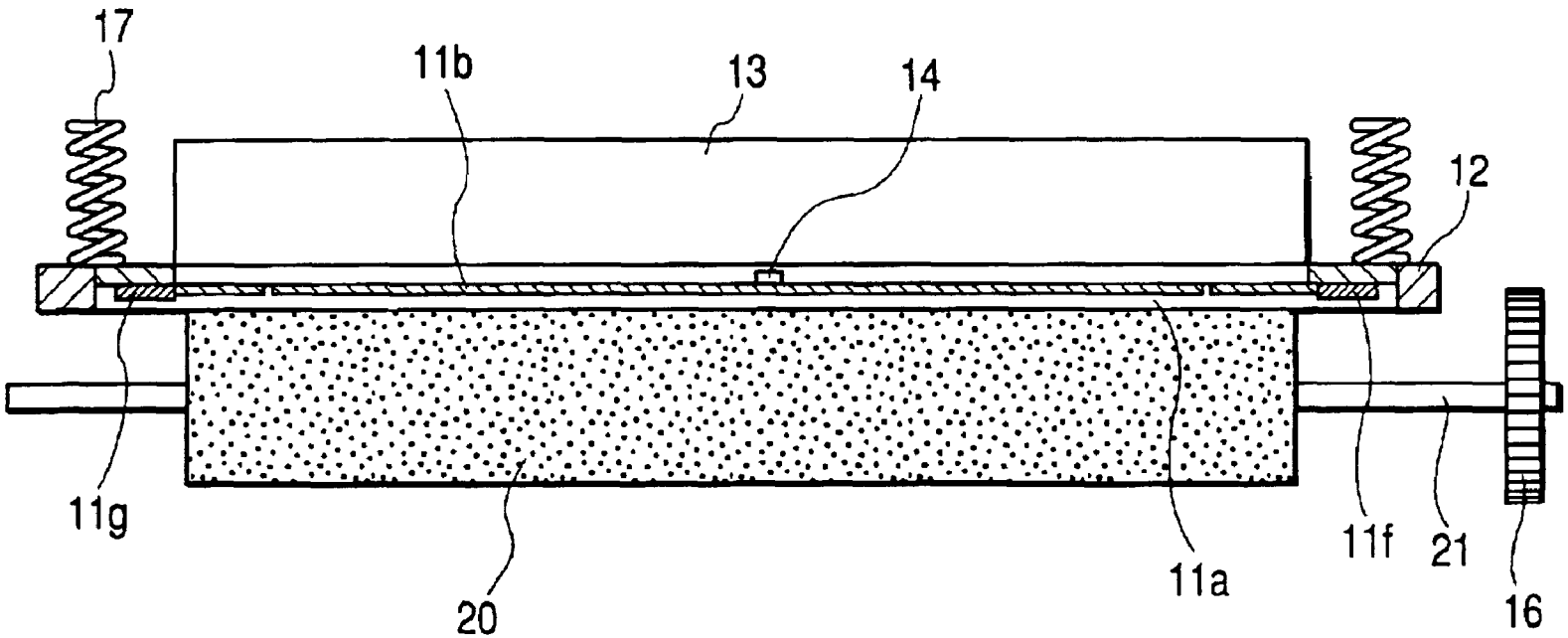
FIG. 4 represents the lengthwise direction of the image heating apparatus of the present invention.

The fixing member 10 is sufficiently pressurized from the lengthwisely opposite end portions thereof to form the fixing nip portion N necessary for heat fixing, toward the above-described pressure member 20 by pressurizing means 17 such as springs through a portion of the adiabatic stay holder 12 or a member attached to the adiabatic stay holder as by fitting, as shown in FIG. 4.

Also, the pressure roller 20 is rotatively driven by a drive gear 16 mounted on an end of the mandrel 21 of the pressure roller 20, and by the friction between the surface of the pressure roller and the surface of the metallic film, the metallic film is driven to rotate at a predetermined speed.

What has been described above is the construction of the heat fixing apparatus 6, and in FIG. 2, the recording material P is suitably supplied by supplying means, not shown, and is conveyed to the fixing nip portion N formed along a heat resistant fixing entrance guide 15 by the heating member 10 and the pressure member 20.

e) About the Surface Roughness, etc. of the Inner and Outer Surfaces of the Metallic Sleeve 13

Description will hereinafter be made of the surface roughness of the inner and outer surfaces of the metallic sleeve 13 according to the present embodiment, the thickness of the mold releasable layer, etc.

Figure 9:
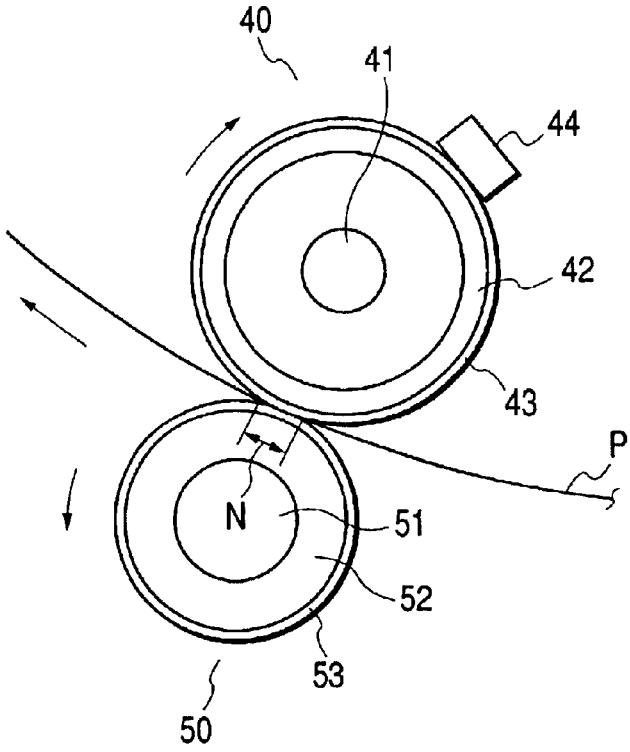
FIG. 9 is a cross-sectional view of a heat roller type fixing apparatus.

First, it is necessary for the inner surface of the metallic sleeve 13 to contact with the heating heater 11 with a predetermined contact width to thereby transfer the heat generated from the heating heater 11 to the fixing nip portion N, and this differs in idea from the heretofore used heat roller fixing apparatus (FIG. 9) for effecting the heating by radiant heat. Consequently, the surface roughness of the inner surface of the metallic sleeve 13 contacting with and transferring the heat of the heating heater 11 greatly affects heat efficiency. Particularly, when the contact thermal resistance between the surface of the sliding layer 11*c* (FIG. 3A) or 11*e* (FIG. 3B) of the heating heater 11 and the inner surface of the metallic sleeve 13 becomes great, heat efficiency is aggravated to thereby cause poor fixing. Even if heat conducting grease or the like is interposed, the construct a heat fixing apparatus of high heat efficiency, it is necessary to suppress the aforementioned surface roughness to predetermined or lower surface roughness.

Also, a mold releasable layer is formed on the outer surface of the metallic sleeve 13, but the mold releasable layer is generally formed of fluorine resin and therefore, the heat conductivity thereof is extremely low as compared with the heat conductivity of the metallic sleeve 13. Consequently, if the mold releasable layer is formed too thickly, the aggravation of heat conduction will result and when the metallic sleeve is used in a printer of high treating capability, sufficient heat supply will become impossible to the toner image on the recording material P in the fixing nip portion N. Consequently, it is necessary to form a thin mold releasable layer on the metallic sleeve 13. At this time, it is necessary to suppress the surface roughness of the outer surface of the metallic sleeve 13 to predetermined or smaller surface roughness. That is, by a thin mold releasable layer, the effect of alleviating the surface roughness of the outer surface of the metallic sleeve 13 is not obtained, and the surface roughness after the mold releasable layer has been applied to and formed on the outer surface of the metallic sleeve 13 becomes surface roughness equal to or somewhat smaller than the surface roughness of the blank tube of the metallic sleeve 13. Consequently, if the surface roughness of the blank tube of the metallic sleeve 13 is great, it will become great surface roughness even after the application and formation of the mold releasable layer, and the close contact force with respect to the recording material P will not be obtained in the fixing nip portion N, and the possibility of causing poor fixing will become great.

Thus, the surface roughness of the outer surface of the metallic sleeve 13 is made into predetermined or smaller surface roughness and the mold releasable layer is applied and formed with a predetermined or smaller thickness (if there is a primer layer, a thickness including it), whereby sufficient fixing performance is obtained, and it becomes possible to cope with the higher speed of the image forming apparatus.

Also, when the surface roughness of the outer peripheral surface of the metallic sleeve 13 is great, if such paper as cut paper made from pulp as a raw material is introduced as the recording material P into the fixing nip portion N and is heated and fixed, paper dust on the paper may be scraped off and adhere to the surface of the metallic sleeve 13, and if in such a state, the recording material P having an unfixed toner image formed thereon continues to be heated and fixed, the paper dust having bad mold releasability will strips off the toner on the recording material, and gradually the paper dust and the toner will collect on the surface of the metallic sleeve and in the worst case, mold releasability will become null to such an extent that the recording material P will not separate from the metallic sleeve, and the recording material P will twice around the surface of the metallic sleeve 13.

From the above-noted point of view, it is necessary to suppress the surface roughness of the surface of the metallic sleeve 13 to a predetermined value or less.

In confirmation of the foregoing, each effect has been confirmed by allotting the roughness of the inner surface and the roughness of the outer surface of the metallic sleeve 13 and the thickness of the mold releasable layer. The confirmed construction is as shown below.

First, in the basic construction of the heat fixing apparatus used in an experiment when the roughness of the inner surface of the metallic sleeve 13 was allotted, a heater of the construction of FIG. 3B was used as the heating heater 11. That is, AlN (aluminum nitride) was used as the substrate 11*a*, and on that surface of this heater substrate 11*a* which is opposite to the surface opposed to the fixing nip portion N, a mixture of Ag/Pd as an electrically conductive agent and phosphoric acid glass as a matrix component mixed with an organic solvent, a binder, a dispersing agent, etc. and thereby formed into paste was screen-printed as the electrical energizing heat generating resistance layer 11*b* and was sintered at 600° C. Also, a polyimide layer 11*e* of good slidability was screen-printed and formed with a thickness of 10 $\mu$m on that surface of the heater substrate 11*a* of AlN which is opposed to the fixing nip portion N.

Also, the metallic sleeve 13 was formed into a cylindrical shape having an outer diameter of 30.13 mm by applying a primer layer of 5 $\mu$m and PFA resin of 10 $\mu$m to cylindrical stainless steel having an inner diameter of 30 mm and a thickness of 50 $\mu$m by dipping.

Also, the pressure roller 20 was made by forming a silicon rubber layer with a thickness of 5 mm on an Al mandrel 21 of a diameter of 20 mm (Φ 20 mm), and further the outer layer thereof was covered with a PFA tube.

In an experiment, the recording material conveying speed of the image forming apparatus was adjusted so as to be 200 mm/sec., and the attempered temperature of the heating heater 11 was controlled so as to be 200° C., and in six seconds after the electrical energization of the electrical energizing heat generating resistance layer 11*b* of the heating heater 11 was started, a recording material P having an unfixed toner image formed thereon was inserted into the fixing nip portion N, and confirmation was made for each item.

Also, the surface roughness (ten-point height of irregularities) Rz of the inner surface of the metallic sleeve 13 according to the present embodiment was allotted up to 2 μm to 5 μm and confirmed (Embodiments 1 to 5).

Figure 10:
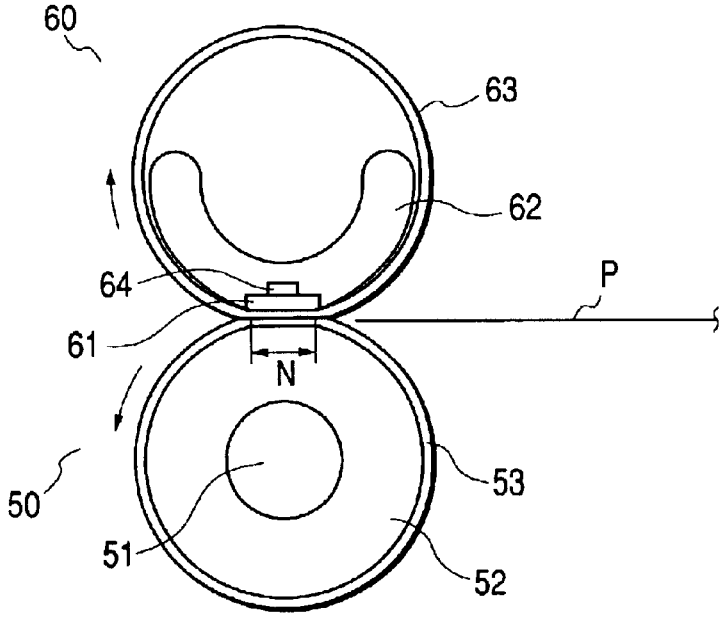
FIG. 10 is a cross-sectional view of a film contact type fixing apparatus in which the base layer of a sleeve is heat-resistant resin.

As a comparative example, a case where instead of the metallic sleeve 13, use was made of the fixing film 63 (FIG. 10) shown in the example of the related art that was formed with polyimide resin as a base layer was likewise confirmed. In the fixing film of the comparative example, in order to secure heat conductivity, a primer layer of 5 μm and PFA resin of 10 μm were applied to a polyimide base layer having a thickness of 50 μm and having BN (boron nitride) filler of 30 vol % added thereto, by dipping, and the fixing film was formed with an outer diametral shape equal to that of the above-described metallic sleeve 13, and the surface roughness Rz of the inner surface thereof was 2 μm. Driving was effected by the pressure roller, and evaluation was made with the fixing film driven to rotate.

As a method of confirming the respective items:

(1): fixing performance . . . an adhesive tape was once stuck on the recording material P after heated and fixed, and the fixing performance was judged from the image deficiency when the adhesive tape was stripped off.

(2): quick starting property . . . the temperature of the fixing nip portion N in three seconds after the electrical energization of the electrical energizing heat generating resistance layer 11*b* of the heating heater 11 was started was measured.

(3): enduring performance . . . the number of sheets for which the damage of the fixing film or the metallic sleeve was confirmed when cut paper as the recording material was continuously heated and fixed was counted.

The result of the experiment is shown in Table 1 below. In Table 1, "good" indicates satisfactory fixing performance, "fair" indicates allowable fixing performance, and "fail" indicates that unsatisfactory fixing has occurred.

TABLE 1

| | Inner surface roughness Rz | Firing perform-ance | Temperature of nip 3 seconds after | Enduring number of sheets |
|---|---|---|---|---|
| Embodiment 1 | 2 μm | good | 182° C. | 1 million sheets or more |
| Embodiment 2 | 3 μm | good | 180° C. | 1 million sheets or more |
| Embodiment 3 | 3.5 μm | fair | 176° C. | 1 million sheets or more |
| Embodiment 4 | 4 μm | fail | 171° C. | 1 million sheets or more |
| Embodiment 5 | 5 μm | fail | 163° C. | 1 million sheets or more |
| Comparative Example | 2 μm | fail | 167° C. | 500,000 to 800,000 sheets |

The damage during endurance in Comparative Example is by the tear of end portions.

When as shown in the present embodiment, the surface roughness of the inner surface of the metallic sleeve 13 and the surface roughness of the inner surface of the fixing film are equal to each other, heat efficiency can be markedly improved by using a metallic sleeve 13 higher in heat conductivity than the fixing film made of resin.

Also, if the surface roughness of the inner surface of the metallic sleeve 13 exceeds 3.5 μm, the contact thermal resistance between the heating heater 11 and the inner surface of the metallic sleeve 13 becomes great and the heat transfer into the fixing nip portion N is hampered and therefore, to make the most of the effect of the heat conduction of the metallic sleeve 13, it will be seen that it is desirable to make the surface roughness Rz of the inner surface equal to or less than 3 μm. Thereby it becomes possible to make the attempered temperature of the heating heater 11 low, and there will be provided a heat fixing apparatus more excellent in energy saving.

Also, by using a metallic sleeve 13 of which the surface roughness Rz of the inner surface is 3 μm or less, it becomes possible to quicken the temperature rise of the fixing nip portion N, and this leads to the excellence in quick starting property and the possibility of shortening the first print time.

Consequently, for the higher speed of the image forming apparatus as well, the recording material can be sufficiently heated even within a short conveying time in the fixing nip, and such a problem as poor fixing will not result.

Also, in the evaluation of durability, by using the metallic sleeve of high rigidity, it becomes difficult for the tear from the end portions to occur to the film made of resin, and high enduring performance in obtained.

Next, the surface roughness of the outer surface of the metallic sleeve 13 and the thickness of the mold releasable layer were allotted and the confirmation of the fixing performance of item (1) above and the quick starting property of item (2) above was made.

The construction used in the experiment was similar to what was described above, and the surface roughness Rz of the outer surface of the metallic sleeve 13 was 2 μm to 5 μm, and a primer layer of 5 μm was applied to the outer surface of the metallic sleeve 13, and a mold releasable layer having a thickness of 5 μm to 25 μm was allotted to that outer surface and thus, confirmation was made. Use was made of a metallic sleeve 13 of which the surface roughness Rz of the inner surface was 2 μm. The result of the evaluation is shown in Table 2 below.

TABLE 2

| | Outer surface roughness Rz | Thickness of mold releasable layer | Fixing performance | Temperature of nip 3 seconds after |
|---|---|---|---|---|
| Embodiment 1 | 2 μm | 10 μm | good | 182° C. |
| Embodiment 2 | 3 μm | 5 μm | good | 184° C. |
| Embodiment 3 | 3 μm | 10 μm | good | 181° C. |
| Embodiment 4 | 3 μm | 15 μm | good | 179° C. |
| Embodiment 5 | 3 μm | 20 μm | fair | 173° C. |
| Embodiment 6 | 3 μm | 25 μm | fail | 165° C. |
| Embodiment 7 | 3.5 μm | 10 μm | fair | 180° C. |
| Embodiment 8 | 4 μm | 10 μm | fail | 178° C. |
| Embodiment 9 | 5 μm | 10 μm | fail | 176° C. |

From the result shown above, it will be seen that the surface roughness of the outer surface of the metallic sleeve 13 somewhat affects the temperature in the fixing nip portion N, but when the toner image on the recording material P is heated and fixed, the greater becomes the roughness of the outer surface of the metallic sleeve 13 in the applied state of the mold releasable layer, the more occurs the bad contact with the recording material P, and this leads to poor fixing. Particularly, if the surface roughness of the outer surface of the metallic sleeve 13 exceeds 3.5 μm, a tendency toward worse fixing performance is seen and therefore, it is desirable that the surface roughness Rz of the outer surface of the metallic sleeve 13 be 3 μm or less.

Also, if the thickness of the mold releasable layer exceeds 20 μm, the fixing nip portion N will be come incapable of being sufficiently heated due to the aggravation of heat conduction, and the heat fixing apparatus will become inferior in fixing performance. From this, it is desirable that the total thickness of the primer layer and the mold releasable layer applied to the outer surface of the metallic sleeve 13 be 20 μm or less.

Also, when paper dust stain was confirmed by the use of cut paper and by the use of metallic sleeves 13 to which the surface roughness of the outer surface shown above was allotted, paper dust stain occurred to the metallic sleeves in which Rz is 4 μm or greater. In contrast, in the metallic, sleeves of which the surface roughness Rz after the application of the mold releasable layer was 3 μm or less, the adherence of paper dust was within an allowable range and did not remarkably deteriorate the mold releasability.

If the surface roughness of the outer surface of the metallic sleeve including the mold releasable layer is great, when use is made of a recording material such as cut paper made form a pulp material as a raw material, it is considered that paper dust is stripped onto the metallic sleeve by the friction thereof with the paper.

From the above-noted point of view as well, it is desirable that the surface roughness Rz of the outer surface of the metal blank tube be suppressed to 3 μm or less.

Next, in the above-described experimental construction, glass, polyamideimide, PTFE and DLC (diamond-like carbon) were used as the material of the sliding layer 11*e* (FIG. 3B) of the heating heater 11 and were respectively screen-printed to 10 μm (but DLC was formed to a thickness of 1 μm by PVD (physical vapor deposition), and a recording material conveyance enduring test for 200,000 sheets was carried out, and the surface of the heating heater 11 and the abraded state of the metallic sleeve 13 after the endurance were observed and the driving torque of the heat fixing apparatus was measured.

The result of the evaluation is shown in Table 3 below. Regarding the abraded state of the heating heater in the table below, abrasion of 2 μm or less is "good", abrasion of 2 to 7 μm is "fair", and abrasion greater than 7 μm is "fail". Also, regarding the abraded state of the metallic sleeve, 1 μm or less is "good", and abrasion exceeding 1 μm is "fail".

TABLE 3

| Material of sliding layer | Abraded state of heater | Abraded state of sleeve | Driving torque |
|---|---|---|---|
| Glass | fair | fail | 61N cm (6.2 kgf.cm) |
| Polyimide | good | good | 31N.cm (3.2 kgf.cm) |
| Polyamideimide | fair | good | 36N.cm (3.7 kgf.cm) |
| PTFE | fair | good | 37N.cm (3.8 kgf.cm) |
| DLC | good | fail | 57N.cm (5.8 kgf.cm) |

From the result shown above, it has been found that the sliding layer 11*e* formed on the surface of the heating heater 11, when it is formed of a hard material like DLC, abrades the inner surface of the metallic sleeve 13 and the driving torque becomes abnormally high.

In the case of a material such as glass, shavings shave both of the sliding layer 11*e* of the heating heater 11 and the metallic sleeve 13.

On the other hand, in a resin-coated heating heater 11, the resin coat is sometimes shaved, but it becomes possible to suppress the rise of the torque to some extent and durability becomes good. Particularly in a heating heater coated with polyimide, high durability is achieved without any problem. Further, the smaller is the surface roughness of the inner surface of the metallic sleeve, the less becomes the abrasion of the resin sliding layer of the heating heater. Particularly when the surface roughness Rz of the inner surface of the metallic sleeve is 3 μm or less, there can be provided a heat fixing apparatus of high durability.

Simply by making the surface roughness Rz of the inner surface of the metallic sleeve equal to or less than 3 μm as descried above, the contact thermal resistance with the heater is lowered and heat efficiency is improved. Particularly in the present embodiment, the surface roughness of the inner and outer surfaces of the metallic sleeve 13 is made equal to or less than 3 μm, and the thickness of the mold releasable layer including the adhesive layer is made equal to or less than 20 μm, and the sliding layer 11*e* of the heating heater 11 is coated with resin, whereby for the demand for the higher speed of the image forming apparatus, there can be provided a heat fixing apparatus which sufficiently satisfies fixing performance, durability and quick starting property:

(Second Embodiment)

Embodiment 2 will hereinafter be descried. The general construction of the image forming apparatus is similar to that of FIG. 1 shown in Embodiment 1, and the construction of the interior of the heat fixing apparatus is also similar to that of FIG. 2 shown in Embodiment 1 and therefore, need not be described.

In the present embodiment, the outer peripheral surface of the metallic sleeve 13 is given a spiral uneven shape to thereby make the rotation of the metallic sleeve 13 smoother and also make the mold releasable layer coating the surface of the heating heater 11 difficult to injure. Thus, there is provided a heat fixing metallic sleeve 13 of still higher durability that can cope with a higher speed.

In the present embodiment, a method of manufacturing the metallic sleeve 13 in FIG. 2 shown in Embodiment 1 is achieved by a method shown below, and moderate unevenness is formed circumferentially of the metallic sleeve 13.

Figure 5:
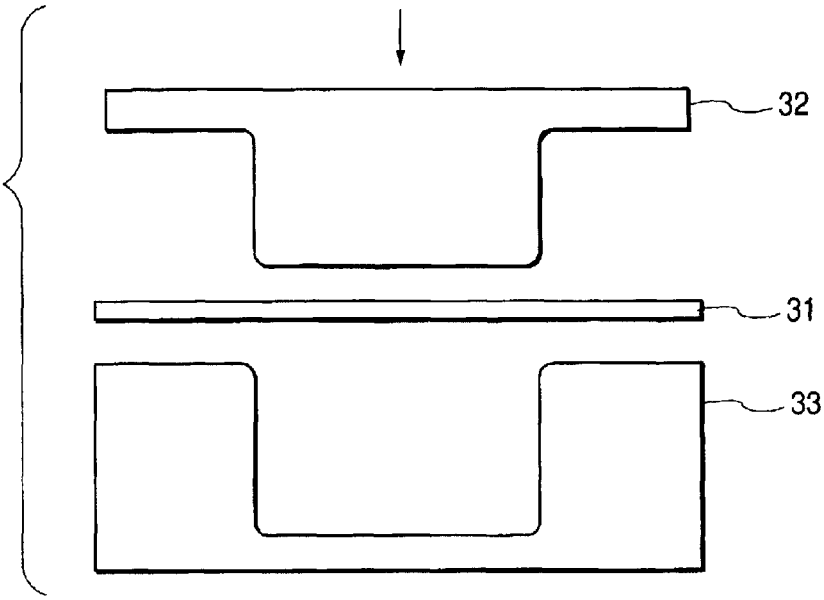
FIG. 5 shows an apparatus for manufacturing the metal blank tube of a rotary member used in the image heating apparatus of the present invention.
Figure 6:
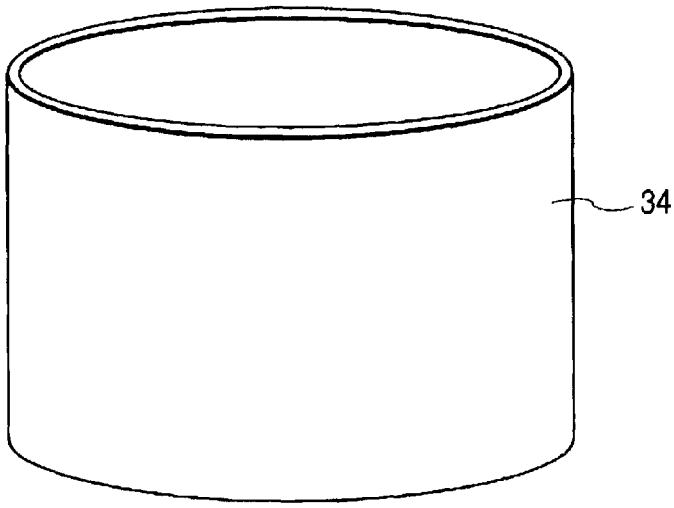
FIG. 6 is a perspective view of the metal blank tube as it has been taken out of the apparatus shown in FIG. 5.

A main manufacturing method for the metallic sleeve 13 is shown in FIGS. 5, 6 and 7A through 7C. First, in FIG. 5, the reference numeral 31 designates the base material of the metallic sleeve 13 which is a flat metal plate (plank) of the order of 0.1 mm to 0.5 mm formed of SUS, Al, Ni, Cu, Zn or the like or an alloy thereof. The reference numeral 32 denotes a circular inner mold (punch) in an ordinary deep drawing method, and the reference numeral 33 designates a cylindrical container-shaped outer mold (die) which is a metal mold having the surface of its metal material subjected to super-hard plating or the like. In FIG. 5, the flat metal plate 31 is sandwiched between the inner mold 32 and the outer mold 33 and the inner mold 32 is pushed in the direction of arrow toward the outer mold 33. Also, lubricating oil of high viscosity or a solid lubricant such as graphite or molybdenum disulfide is interposed between the flat metal plate 31 and the outer mold 33 to thereby make the drawing property good. The above-described process is repeated usually twice to four times by deep-drawing by a different metal mold to thereby manufacture a cup-shaped metallic cylindrical member 34 as shown in FIG. 6.

Figure 7A:
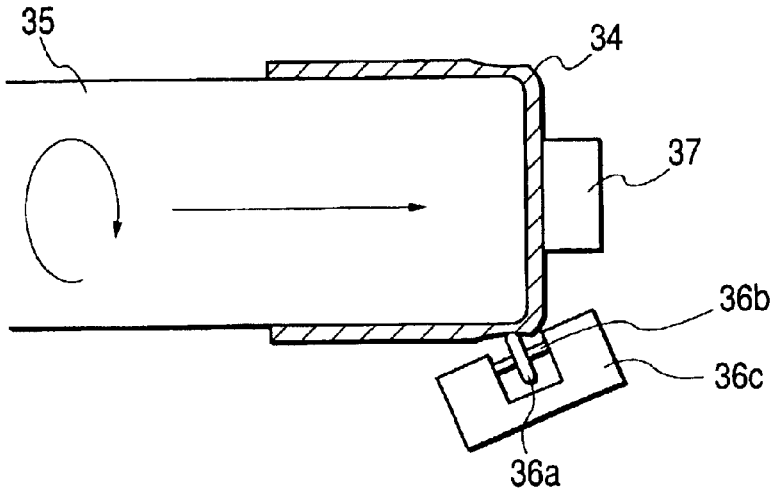
FIGS. 7A and 7B show a state in which the outer peripheral surface of the metal blank tube of FIG. 6 is subjected to the ironing process.
Figure 7B:
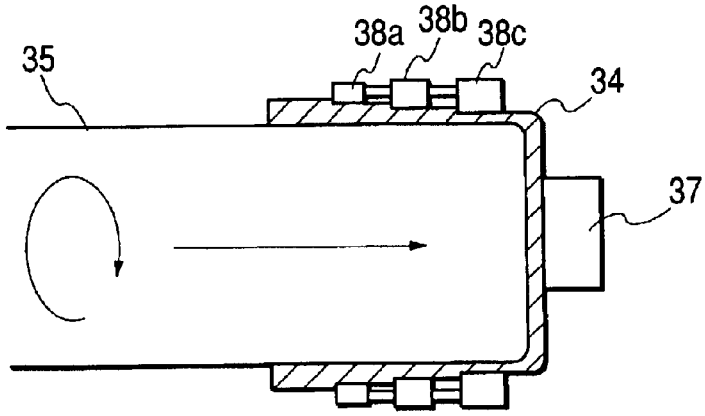

Next, this metallic cylindrical member 34 is subjected to the ironing step so as to be formed to a predetermined thickness. As the ironing step, any step such as the rolling step, the extracting step or the drawing step may intervene in the course, but as the final step, by a working method as shown below, working having predetermined or smaller unevenness is effected circumferentially of the metallic sleeve. For example, there is a working method as shown in FIGS. 7A and 7B. FIG. 7A shows ordinary drawing spinning working, in which a push roller 36*a* rotatably mounted on a shaft 36*b* attached to a fixed stand 36*c* is adapted to be urged toward a metallic inner mold 35 always in a state in which it is spaced apart from the metallic inner mold 35 by a predetermined distance. The above-described metallic cylindrical member 34 subjected to the deep drawing step into the cup shape is fitted onto the metallic inner mold 35, and is fixed with the bottom of the cup shape of the metallic cylindrical member 34 brought into close contact with the metallic inner mold 35 by a keep member 37. In this state, the metallic inner mold 35, the metallic cylindrical member 34 and the keep member 37 are gradually fed in rightwardly while being rotated in the direction of arrow. From the end portion, the rotatable roller is pushed against it while keeping a predetermined distance from the metallic inner mold 35.

Figure 7C:
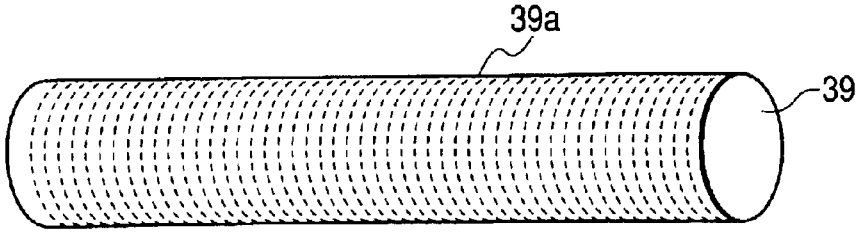
FIG. 7C is a perspective view showing the surface state of the metal blank tube after ironing process.

Thereby, the metallic cylindrical member 34 is gradually thinned from the end portions thereof by ironing and finally, as shown in FIG. 7C, a cup-shaped metallic cylindrical member 39 worked to the predetermined thickness of the metallic sleeve 13 in the present embodiment is formed by ironing.

The uneven mark 39*a* of the roller pushing during drawing spinning remains circumferentially of the metallic cylindrical member 39. That is, a spiral streak as shown in FIG. 7C is formed on the outer peripheral surface of the cylindrical member 39. Finally, the bottom of the cup shape of the metallic cylindrical member 39 is cut off to thereby obtain the metallic sleeve 13 in the present embodiment.

Also, as shown in FIG. 7B, there may be adopted a method whereby instead of the push roller, a metallic cylindrical member 34 fixed inside continuous dies 38*a*, 38*b*, 38*c* having their inner diameters stepwisely formed small by a metallic inner mold 35 and a keep member 37 is fed in while being rotated and is provided with a circumferential uneven shape while being thinned by ironing.

Besides, there may be adopted any working method by ironing if it is a method such as spinning which can form a predetermined or smaller amount of unevenness circumferentially of the metallic sleeve 13.

When the recording material P having an unfixed image formed thereon is to be heated and fixed by the use of the metallic sleeve 13 manufactured by the above-described manufacturing method, it is necessary from the viewpoint of heat conduction to suppress the unevenness of the inner and outer surfaces of the metal layer as shown in the aforedescribed Embodiment 1.

Also, the rotative driving torque of the heat fixing apparatus in the experimental construction shown in Embodiment 1, and the abrasion of the polyimide coat as the sliding layer 11*e* provided on the heating heater 11 during the endurance when 500,000 sheets of recording materials were heated and fixed were evaluated by the use of a metallic sleeve (the embodiment) comprising a metal blank tube on which the unevenness of the streak on the outer peripheral surface is formed with 3 μm (the surface roughness Rz is 3 μm in the lengthwise direction (the direction orthogonal to the direction of rotation, and Rz is 1 μm or less in the circumferential direction) at a pitch of 0.2 mm over the lengthwise direction and which is coated with a primer layer and a mold releasable layer, and metallic sleeves (Comparative Examples 1 and 2) on which the surface roughness Rz of the inner surface and the surface roughness Rz of the outer surface of the metallic sleeve are formed with equal 1 μm, 3 μm in any directions irrespective of the circumferential direction and the lengthwise direction. The result of the evaluation is shown in Table 4 below. The evaluation standard is similar to that in Embodiment 1.

TABLE 4

| | Driving torque | Abraded state of heater |
|---|---|---|
| Embodiment | 31N.cm (3.2 kgf.cm) | good |
| Comparative Example 1 (Rz =1 μm) | 36N.cm (3.7 kgf.cm) | good |
| Comparative Example 2 (Rz = 3 μm) | 34N.cm (3.5 kgf.cm) | fair |

From the result shown above, the surface roughness Rz, preferably in the lengthwise direction, forming unevenness of 3 μm or less in the circumferential direction of the metallic sleeve 13 is made equal to or less than 3 μm, and the relation thereof with surface roughness Rz' in the circumferential direction is Rz>Rz', whereby it becomes possible to make the rotative driving of the heat fixing apparatus low and make the rotation thereof smooth, and also make the resin coat of the heating heater contacting with the inner surface of the metallic sleeve by endurance difficult to injure, and achieve the still higher durability and higher speed of the heat fixing apparatus.

Particularly when a state approximate to a mirror surface state is brought about in both of the circumferential direction and the lengthwise direction (Comparative Example 1), the close contact between the inner surface of the metallic sleeve and the sliding surface of the heating heater becomes good and the fixing property becomes good as shown in Embodiment 1, but the driving torque becomes somewhat high.

Consequently, to satisfy the fixing property and moreover, maintain the smooth rotation of the metallic sleeve 13, the metallic sleeve of the present embodiment having unevenness of Rz of 3 μm or less in the lengthwise direction thereof is better suited.

(Third Embodiment)

Embodiment 3 will hereinafter be described. The general construction of the image forming apparatus is similar to that of FIG. 1 shown in Embodiment 1, and the construction of the interior of the heat fixing apparatus is also similar to that of FIG. 2 shown in Embodiment 1 and therefore need not be described.

In the present embodiment, a potential difference is formed between the metallic sleeve 13 and the pressure roller 20 which is a pressure member and the metallic sleeve 13 is brought into its grounded state or brought into its grounded state through a diode to thereby make it difficult for paper dust and the toner to adhere to the metallic sleeve 13, thus providing a heat fixing apparatus which maintains mold releasability through endurance.

Figure 8A:
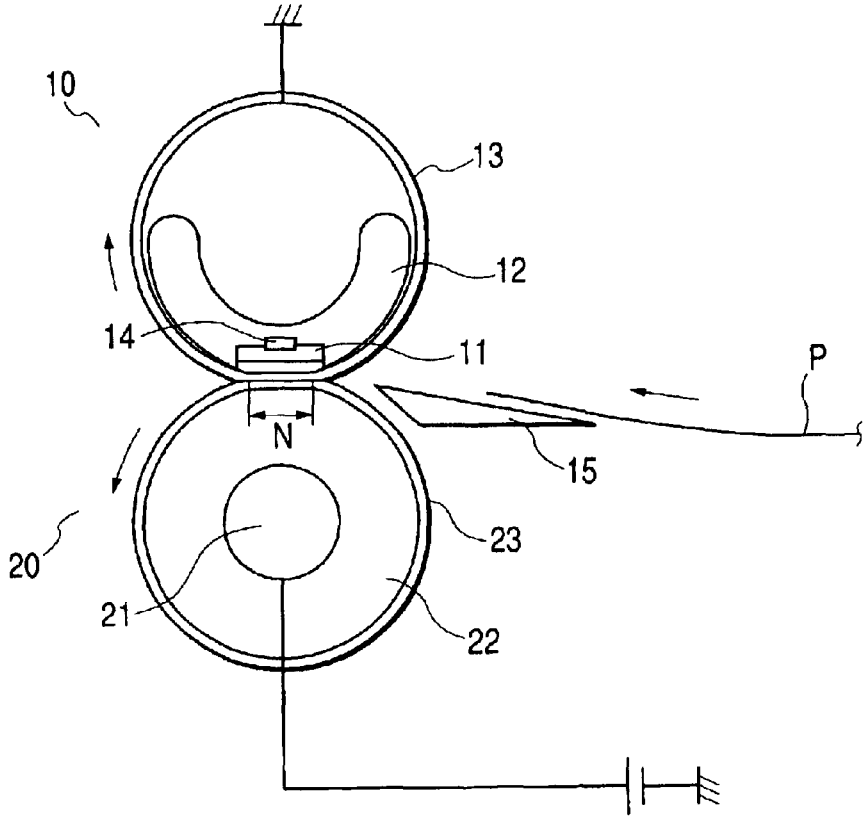
FIGS. 8A and 8B represent a cross-sectional view and the lengthwise direction, respectively, of a fixing apparatus according to a third embodiment.
Figure 8B:
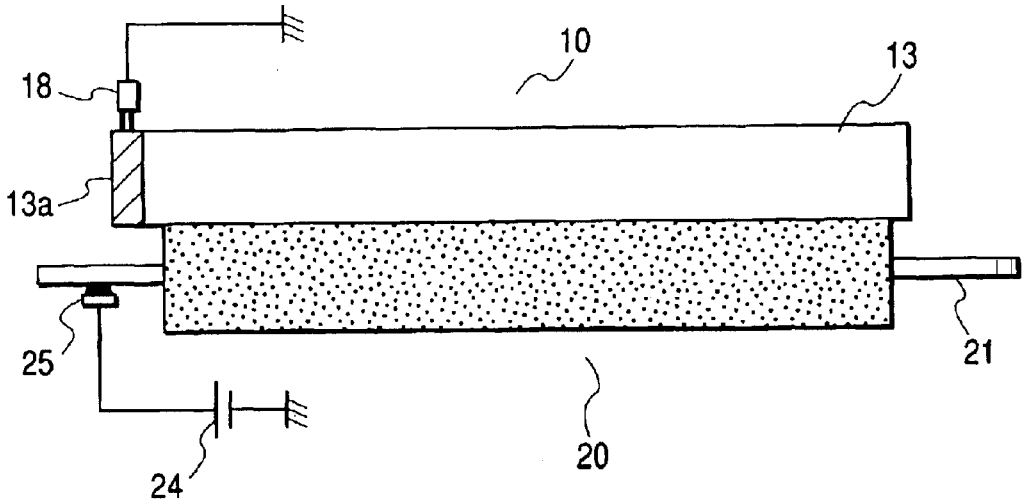

FIGS. 8A and 8B show the more detailed construction of the heat fixing apparatus in the present embodiment. In FIGS. 8A and 8B, the elastic layer 22 of the pressure roller 20 which is a pressure member is an elastic layer formed of electrically conductive silicon rubber, electrically conductive silicon sponge or the like and given electrical conductivity, and a bias opposite in polarity to the toner image is applied to the mandrel 21 or the electrically conductive elastic layer 22 of the pressure roller by bias applying means 24 through a chip electrode 25 comprising an electrically conductive carbon chip or the like.

In these figures, the heat fixing apparatus is shown on the basis of an image forming apparatus in which the toner is charged to minus in a developing portion, and is designed such that a plus bias is applied to the mandrel 21 of the pressure roller.

Consequently, in the case of an image forming apparatus in which the toner is charged to plus in a developing portion, design is made such that a minus bias is applied to the mandrel 21 of the pressure roller.

Also, on an end portion of the metallic sleeve 13, there is provided a region 13*a* in which a metallic sleeve plank not coated with a primer layer as an adhesive layer and a mold releasable layer comprising a fluorine resin layer is exposed, and the sleeve is designed to be grounded by this region 13*a* through an electrically conductive brush 18 formed of amorphous electrically conductive fiber.

Alternatively, the metallic sleeve may be diode-connected so that charges of the same potential as the toner may be held on metallic film.

By the above-described construction, design is made such that a bias is positively applied to the pressure roller 20 side, whereby it becomes difficult for paper dust, the toner etc. to be adsorbed to the metallic sleeve 13.

Consequently, in the above-described heat fixing apparatus when a toner image formed on cut paper or the like made from a pulp material as a main raw material is to be heated and fixed, it is electrostatically difficult for the contamination by paper dust and the toner to occur to the mold releasable layer on the surface of the metallic sleeve 13 of which the surface roughness Rz is 3 μm or less, and mold releasability is not spoiled by endurance and therefore, there is provided a heat fixing apparatus of long life.

In order to confirm the above-described effect, in the experimental apparatus shown in the aforedescribed Embodiment 1, comparison was made about the adherence of paper dust by endurance between the present embodiment in which a bias of +500V was applied to the pressure roller side (the metallic sleeve side was grounded) and the comparative example in which a bias of −500V was applied to the metallic sleeve (the pressure roller side was grounded).

When the surface roughness Rz of the outer surface of the metallic sleeve 13 is 3 μm or less, it is difficult for paper dust to adhere thereto and therefore, both were experimented with Rz of 3.5 μm for which it is somewhat easy for paper dust to adhere.

Two hundred thousand sheets of cut paper were heated and fixed with a result that in the present embodiment wherein a bias was applied to the pressure roller 20 side, the adherence of paper dust was hardly seen, whereas in the comparative example wherein a bias was applied to the metallic sleeve side, the adherence of paper dust was seen from the order of 150,000 sheets, and for 200,000 sheets, the adherence of the toner was also seen.

From what has been described above, the present embodiment in which the surface roughness Rz of the outer surface of the metallic sleeve 13 coated with the mold releasable layer is 3 μm or less and a bias is positively applied to the pressure roller 20 side and the metallic sleeve 13 side is grounded or diode-connected is of a construction in which it is more difficult for the contamination by the adherence of the paper dust of the recording material P and the toner to the surface of the metallic sleeve 13 to occur, and can provide a heat fixing apparatus which can maintain good mold releasability for longer endurance.

(Others)

1) The fixing apparatus is equally effective irrespective of oil fixing or oilless fixing.

2) The heating member (heater) may also be an electromagnetic induction heat-generative member.

3) The fixing apparatus of the present invention also covers an image heating apparatus for tentatively fixing an image on a recording material, an image heating apparatus for improving image surfaceness such as luster, etc.

The present invention is not restricted to the above-described embodiments, but covers modifications within the technical idea thereof.

What is claimed is:

1. An image heating apparatus comprising:

a heater; and a rotary member rotated while contacting with said heater, said rotary member having a metal layer contacting with said heater, wherein a surface roughness Rz of a contact surface of said metal layer with said heater is 3 μm or less, and wherein the surface roughness Rz of a surface on a side of said metal layer which does not contact with said heater is 3 μm or less.

2. An image heating apparatus according to claim 1, wherein said rotary member has a heat-resistant resin layer on the surface on the side of said metal layer which does not contact with said heater.

3. An image heating apparatus according to claim 2, wherein a thickness of said heat-resistant resin layer is 20 μm or less.

4. An image heating apparatus according to claim 1, wherein said heater has a resin layer on a surface thereof which contacts with said rotary member.

5. An image heating apparatus according to claim 4, wherein said resin layer has polyimide.

6. An image heating apparatus according to claim 1, wherein said heater is provided in an interior of said rotary member.

7. An image heating apparatus according to claim 1, wherein the surface of said metal layer on the side that does not contact with said heater is subjected to an ironing process.

8. An image heating apparatus according to claim 1, wherein the surface of said metal layer on the side which does not contact with said heater has a spiral streak, and the surface roughness Rz of the surface in a direction substantially orthogonal to a direction of rotation of said rotary member is 3 μm or less.

9. An image heating apparatus according to claim 8, wherein the surface roughness Rz of the surface of said metal layer on the side which does not contact with said heater in the direction of rotation of said rotary member is 1 μm or less.

10. A rotary member for use in an image heating apparatus having:

a metal layer lying on an innermost surface of said rotary member, wherein a surface roughness Rz of an inner peripheral surface of said metal layer is 3 μm or less, and wherein a surface roughness Rz of an outer peripheral surface of said metal layer 3 μm or less.

11. A rotary member according to claim 10, wherein said rotary member has a heat-resistant resin layer on the outer peripheral surface of said metal layer.

12. A rotary member according to claim 11, wherein a thickness of said heat-resistant resin layer is 20 μm or less.

13. A rotary member according to claim 10, wherein the outer peripheral surface of said metal layer is subjected to an ironing process.

14. A rotary member according to claim 10, wherein the outer peripheral surface of said metal layer has a spiral streak, and the surface roughness Rz of the surface in a direction substantially orthogonal to a direction of rotation of said rotary member is 3 μm or less.

15. A rotary member according to claim 9, wherein the surface roughness Rz of the outer peripheral surface of said metal layer in the direction of rotation of said rotary member is 1 μm or less.

* * * * *

UNITED STATES PATENT AND TRADEMARK OFFICE

CERTIFICATE OF CORRECTION

PATENT NO. : 6,748,192 B2
DATED : June 8, 2004
INVENTOR(S) : Satoru Izawa et al.

It is certified that error appears in the above-identified patent and that said Letters Patent is hereby corrected as shown below:

Title page,
Item [30], Foreign Application Priority Data, "2001/225439" should read -- 2001-225439 --.

Column 4,
Line 18, "prelimarily" should read -- preliminarily --.

Column 14,
Line 17, "erty:" should read -- erty. --.

Column 18,
Line 49, "layer" should read -- layer is --.

Signed and Sealed this

Thirtieth Day of November, 2004

JON W. DUDAS
*Director of the United States Patent and Trademark Office*

US006748192C1

(12) EX PARTE REEXAMINATION CERTIFICATE (9157th)

United States Patent
Izawa et al.

(10) Number: US 6,748,192 C1
(45) Certificate Issued: Jul. 31, 2012

(54) IMAGE HEATING APPARATUS HAVING METALLIC ROTARY MEMBER CONTACTING WITH HEATER

(75) Inventors: Satoru Izawa, Shizuoka (JP); Akihito Kanamori, Shizuoka (JP); Hiroshi Kataoka, Shizuoka (JP); Eiji Uekawa, Shizuoka (JP); Shinji Hashiguchi, Shizuoka (JP)

(73) Assignee: Canon Kabushiki Kaisha, Ohta Ku, Tokyo (JP)

Reexamination Request:
No. 90/011,893, Sep. 8, 2011

Reexamination Certificate for:

| | |
|---|---|
| Patent No.: | **6,748,192** |
| Issued: | **Jun. 8, 2004** |
| Appl. No.: | **10/201,218** |
| Filed: | **Jul. 24, 2002** |

Certificate of Correction issued Nov. 30, 2004.

(30) Foreign Application Priority Data

Jul. 26, 2001 (JP) ..... 2001/225439

(51) Int. Cl.
*G03G 15/20* (2006.01)

(52) U.S. Cl. ..... 399/329; 399/333

(58) Field of Classification Search ..... None
See application file for complete search history.

(56) References Cited

To view the complete listing of prior art documents cited during the proceeding for Reexamination Control Number 90/011,893, please refer to the USPTO's public Patent Application Information Retrieval (PAIR) system under the Display References tab.

*Primary Examiner*—Kenneth J Whittington

(57) ABSTRACT

The image heating apparatus has a heater and a rotary member rotated while contacting with the heater, and the rotary member has a metal layer contacting with the heater.

In the image heating apparatus, a surface roughness Rz of a contact surface of the metal layer with the heater is 3 μm or less.

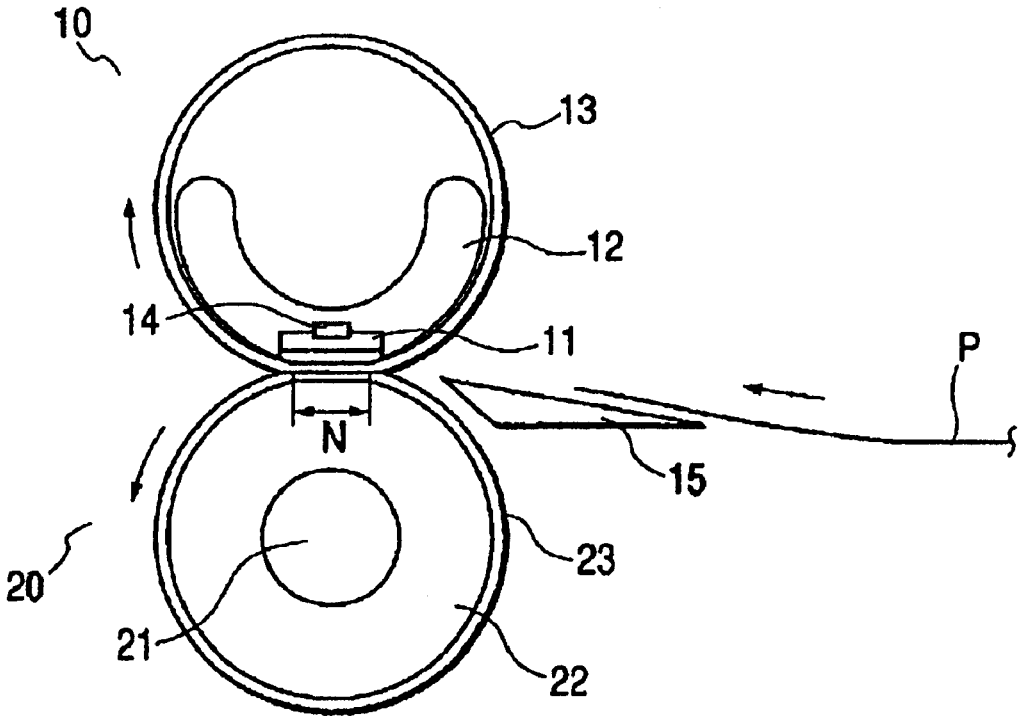

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 8, 9, 14 and 15 are cancelled.

Claims 1, 2, 4, 6, 10, 11, 12 and 13 are determined to be patentable as amended.

Claims 3, 5 and 7, dependent on an amended claim, are determined to be patentable.

New claims 16, 17, 18 and 19 are added and determined to be patentable.

1. An image heating apparatus comprising:

a heater; and a *flexible* rotary member rotated while contacting with said heater, said *flexible* rotary member having a metal layer contacting with said heater, wherein a surface roughness Rz of a contact surface of said metal layer with said heater is 3 μm or less, [and]

wherein the surface roughness Rz of a surface on a side of said metal layer which does not contact with said heater is 3 μm or less,

*wherein the surface of said metal layer on the side which does not contact with said heater has a spiral streak, and the surface roughness Rz of the surface in a direction substantially orthogonal to a direction of rotation of said rotary member is 3 μm or less, and*

*wherein the surface roughness Rz of the surface of said metal layer on the side which does not contact with said heater in the direction of rotation of said rotary member is 1 μm or less.*

2. An image heating apparatus according to claim 1, wherein said *flexible* rotary member has a heat-resistant resin layer on the surface on the side of said metal layer which does not contact with said heater.

4. An image heating apparatus according to claim 1, wherein said heater has a resin layer on a surface thereof which contacts with said *flexible* rotary member.

6. An image heating apparatus according to claim 1, wherein said heater is provided in an interior of said *flexible* rotary member.

10. A *flexible* rotary member for use in an image heating apparatus having:

a metal layer lying on an innermost surface of said *flexible* rotary member, wherein a surface roughness Rz of an inner peripheral surface of said metal layer is 3 μm or less, [and]

wherein a surface roughness Rz of an outer peripheral surface of said metal layer *is* 3 μm or less,

*wherein the outer peripheral surface of said metal layer has a spiral streak, and the surface roughness Rz of the surface in a direction substantially orthogonal to a direction of rotation of said rotary member is 3 μm or less, and*

*wherein the surface roughness Rz of the outer peripheral surface of said metal layer in the direction of rotation of said rotary member is 1 μm or less.*

11. A *flexible* rotary member according to claim 10, wherein said rotary member has a heat-resistant resin layer on the outer peripheral surface of said metal layer.

12. A *flexible* rotary member according to claim 11, wherein a thickness of said heat-resistant resin layer is 20 μm or less.

13. A *flexible* rotary member according to claim 10, wherein the outer peripheral surface of said metal layer is subjected to an ironing process.

*16. An image heating apparatus according to claim 1, wherein said flexible rotary member is a film member.*

*17. An image heating apparatus according to claim 1, wherein said flexible rotary member is a sleeve member.*

*18. A flexible rotary member according to claim 10, wherein said flexible rotary member is a film member.*

*19. A flexible rotary member according to claim 10, wherein said flexible rotary member is a sleeve member.*

* * * * *